US007629525B1

(12) United States Patent
Lin

(10) Patent No.: US 7,629,525 B1
(45) Date of Patent: Dec. 8, 2009

(54) PEDAL ASSEMBLY FOR PERCUSSION INSTRUMENT

(76) Inventor: Hsi-Tan Lin, No. 43, Longshan 3rd St., Daya Shiang (TW) 428

( * ) Notice: Subject to any disclaimer, the term of this patent is extended or adjusted under 35 U.S.C. 154(b) by 0 days.

(21) Appl. No.: 12/404,337

(22) Filed: Mar. 15, 2009

(51) Int. Cl.
*G10D 13/02* (2006.01)

(52) U.S. Cl. ..... 84/422.1

(58) Field of Classification Search ..... 84/422.1, 84/422.3

See application file for complete search history.

(56) References Cited

U.S. PATENT DOCUMENTS

2008/0173159 A1* 7/2008 Chen ..... 84/422.1

* cited by examiner

*Primary Examiner*—Kimberly R Lockett
(74) *Attorney, Agent, or Firm*—Wang Law Firm, Inc.; Li K. Wang

(57) ABSTRACT

A pedal assembly includes a pedal, a base and two frames, a chain is connected between the front end of the pedal and a locking member on the shaft of the base. The rear end of the pedal is pivotably connected to the heel plate so that the pedal is pivotable along the stepping direction. The heel plate and the base are positioned by the respective frames which are fixed to the base and the heel plate by screws. By using the screws, the pedal assembly is stable and made at less material. The frames can be adjusted back and forth to meet different users' needs such that the different sizes of the feet of the users can operate the pedal assembly efficiently.

16 Claims, 11 Drawing Sheets

PEDAL ASSEMBLY FOR PERCUSSION INSTRUMENT

FIELD OF THE INVENTION

The present invention relates to a pedal assembly, and more particularly, to a light and adjustable pedal assembly for percussion instrument.

BACKGROUND OF THE INVENTION

It is important for a band having tens of music instruments to have each of the instruments to be light and easily assembled.

A conventional pedal assembly is shown in FIG. 10, and generally includes a base 71 and a heel plate 72 which is connected to a board 73. The user steps on the pedal 74 pivotably connected to the front end of the heel plate 72 and the pedal 74 is pivoted by the force that the user applies to the pedal 74.

The conventional board 73 is usually heavy so that it is difficult to transport the pedal assembly. Besides, the conventional pedal assembly requires a lot of time to be assembled and dis-assembled. Also, the heavy board 73 needs too much material which means high cost.

Furthermore, the pedal 74 needs to be adjusted according to the user's needs which are usually related to the size of the user's foot. However, the pedal 74 is connected to the base 73 by the heel plate 72, it is difficult to move the pedal 74 inward or outward to meet the user's need. The difficulty relates to the efficiency of operation of the pedal 74.

FIG. 11 shows another conventional pedal assembly which includes a U-shaped support frame 81 and the fixing section 82 of the support frame 81 is fixed to the heel plate 84 by a positioning member 83. Multiple screws 85 are used to fix the fixing section 82 of the support frame 81. Two ends 86 of the support frame 81 are inserted into the two side holes 88 of the base 87.

Although the U-shaped support frame 81 is light and uses less material and can be easily disassembled, the U-shaped support frame 81 is not stable as expected. The unstable support frame 81 swings during use and causes noise which cannot be accepted for any music player.

The pedal 89 in FIG. 11 is connected to the fixing section 82 of the U-shaped support frame 81 by the heel plate 84, the positioning member 83 and screws 85. The two ends 86 of the U-shaped support frame 81 are inserted into the sides holes 88 of the base 87, the pedal 89 cannot be adjusted inward or outward. The drawback is the same as the pedal assembly disclosed in FIG. 10.

The present invention intends to provide a pedal assembly which is composed of a frame, a front board and a rear board, wherein the frame is light in weight and can be easily disassembled and carried. The pedal assembly requires less material and saves time to assemble. The frame of the pedal assembly of the present invention is stable.

SUMMARY OF THE INVENTION

The present invention relates to a pedal assembly which comprises a pivotable pedal and the pedal has a front end thereof connected with a first end of a chain and a rear end of the pedal is connected to a heel plate. A rear board is connected to an underside of the heel plate and two connection portions are located on two sides of the rear board. A base has two posts and a shalt is connected between the two posts. A locking member is connected to the shaft and a beater connection portion is connected to the locking member. A second end of the chain is connected to the locking member. A front board is located beneath the base and has an extension portion on each of two sides of the front board. The extension portions each have a passage defined longitudinally therethrough. An inclined restriction hole is defined in each of the extension portions and communicates with the passage corresponding thereto. Two frames each have an adjusting section on a first end thereof and the adjusting section is inserted into the passage. An adjusting screw extends through the inclined restriction hole and contacts against the adjusting section. A second end of the each of the frames is connected to the connection portion on the rear board corresponding thereto.

Another embodiment of the pedal assembly of the present invention comprises a pedal having a front end connected with a first end of a chain and a rear end of the pedal is connected to a heel plate which includes multiple positioning holes. The pedal is pivotable at the rear end thereof when the user steps on the pedal. A base has two posts with a shaft connected therebetween and a locking member is connected to the shaft on which a beater connection portion is connected. A second end of the chain is connected to the locking member. A front board is located beneath the base and has an extension portion on each of two sides of the front board. The extension portions each have a passage defined longitudinally through a rear end thereof which faces the heel plate. An inclined restriction hole is defined in each of the extension portions and communicates with the passage corresponding thereto.

A U-shaped frame has two legs and a fixing section is connected between the two legs. Each leg includes an adjusting section which is located away from the fixing section. The adjusting sections of the two legs are inserted into the passages. Each inclined restriction hole includes a adjusting screw received therein which contacts against the adjusting section. A positioning member fixes the fixing section to an underside of the heel plate and multiple screws connect the positioning member to the positioning holes.

The primary object of the present invention is to provide a pedal assembly which is composed of frames, a front board and a rear board, wherein the frames are light and can be easily assembled and disassembled and carried. The pedal assembly is made at low cost and the frames are stable.

Another object of the present invention is to provide a pedal assembly wherein the front board includes two passages and the adjusting sections of the frames are adjustably inserted into the passages so as to adjust the position of the pedal to meet different users' needs.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
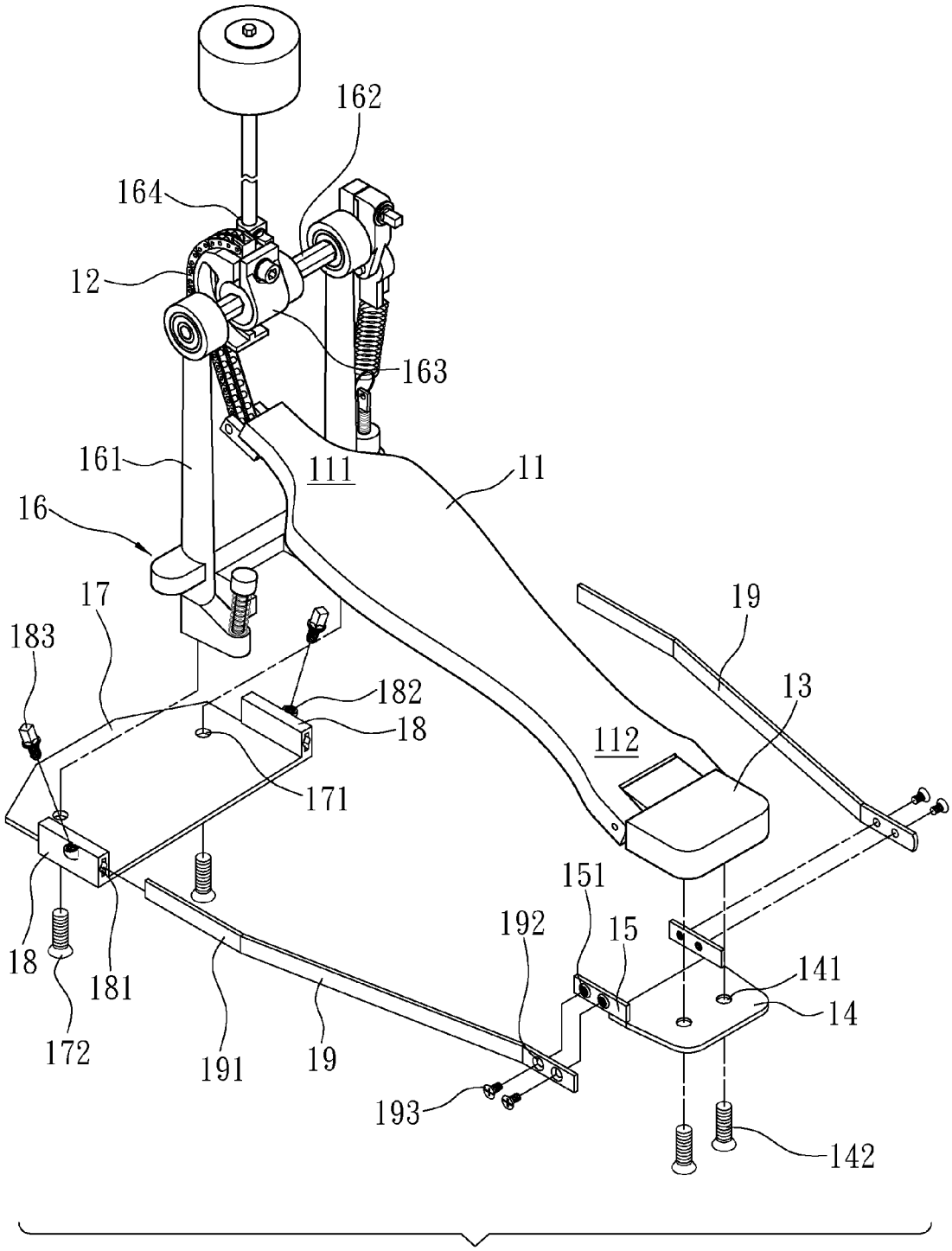
FIG. 1 is an exploded view to show the pedal assembly of the present invention.
Figure 2:
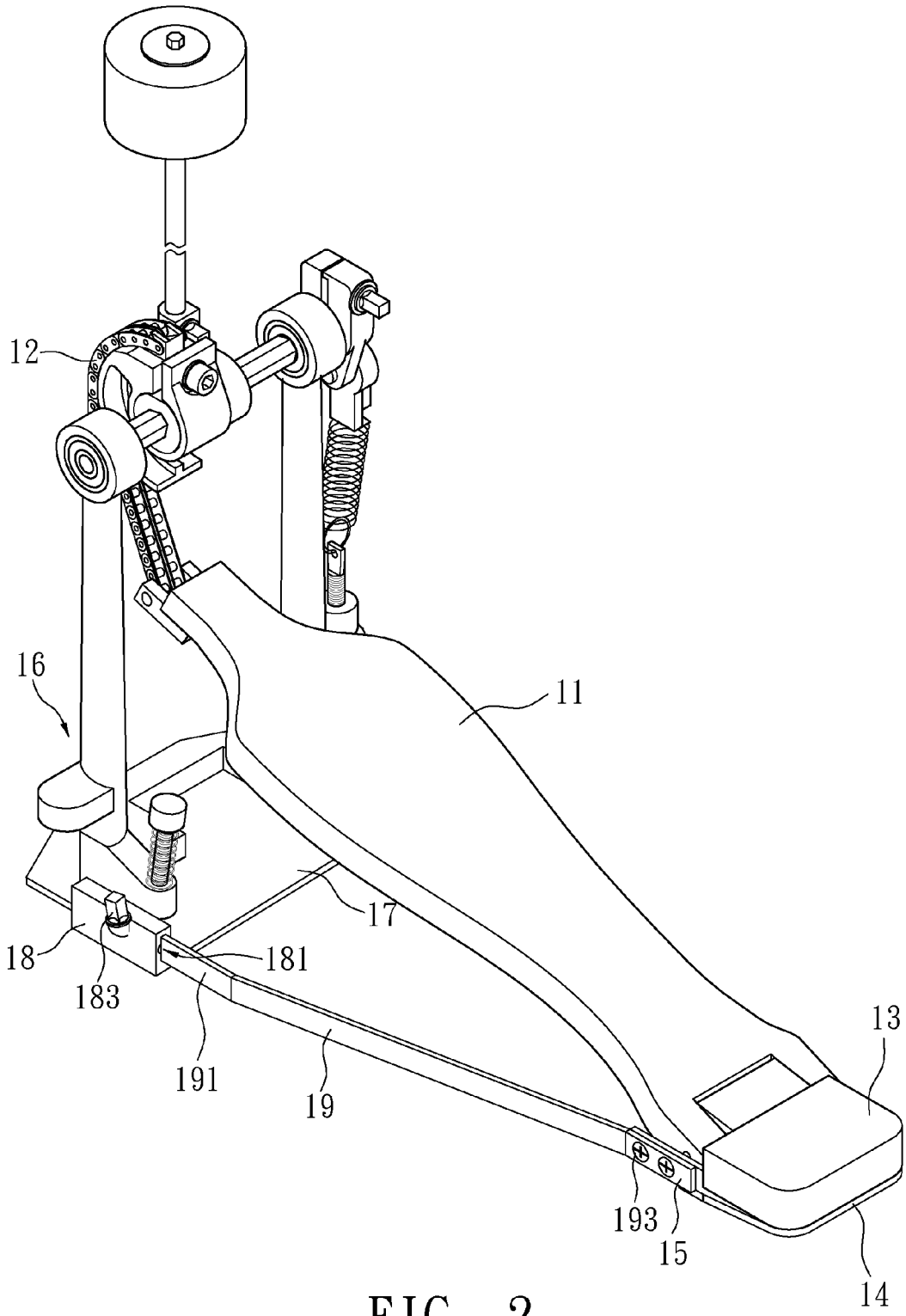
FIG. 2 is a perspective view to show the pedal assembly of the present invention.

Referring to FIGS. 1 and 2, which show the first embodiment of the pedal assembly of the present invention and comprises a pedal 11 having a front end 111 thereof connected with a first end of a chain 12 and a rear end 112 of the pedal 11 is connected to a heel plate 13. The pedal 11 is pivotable at the rear end 112 thereof when the user steps on the pedal 11. A rear board 14 is connected to an underside of the heel plate 13. The rear board 14 includes multiple first holes 141 and screws 193 extend through the first holes 141 so as to connect the rear board 14 to the heel plate 13. In this embodiment, the screws 142 have a flat head. Two connection portions 15 are located on two sides of the rear board 14 and each connection portion 15 has multiple locking holes 151, in this embodiment, there are two locking holes 151 in each connection portion 15.

A base 16 has two posts 161 extending upward from two ends thereof and a shaft 162 is connected between the two posts 161. A locking member 163 is connected to the shaft 162 and a beater connection portion 164 is connected to the locking member 163. A second end of the chain 12 is connected to the locking member 163.

Figure 3:
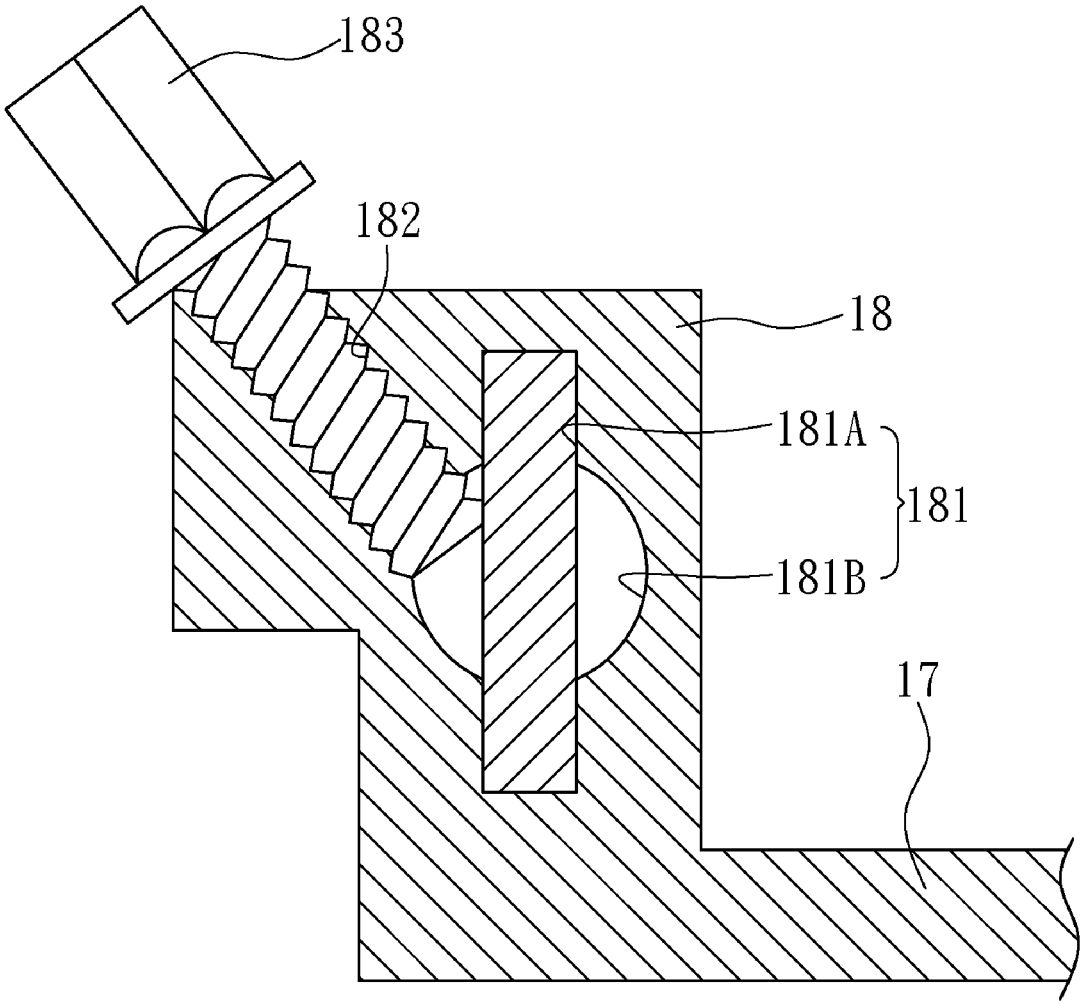
FIG. 3 is a cross sectional view to show the engagement of the passage in the extension portion and the frame.

A front board 17 is located beneath the base 16 and the front board 17 includes multiple second holes 171 and screws 172 extend through the second holes 171 so as to connect the front board 17 to the base 16. In this embodiment, there are two second holes 171 and the screws 172 have a flat head. The front board 17 has an extension portion 18 on each of two sides of the front board 17 and the extension portions 18 each have a passage 181 defined longitudinally therethrough. The passages 181 are drilled in an end facing the rear board 14. Each of the passages 181 extends through two ends of the extension portion 18 corresponding thereto as shown in FIG. 3 and includes a rectangular section 181A and a circular section 181B which is located at a mediate portion of the rectangular section 181A. An inclined restriction hole 182 is defined in each of the extension portions 18 and communicates with the passage 181 corresponding thereto.

In this embodiment, the two extension portions 18 extend upward and longitudinally from the two sides of the front board 17. The two extension portions 18 are parallel to each other, although different arrangement can be used according to practical needs, such as to reduce the length of the extension portion 18 and have two open ends. This alternative arrangement saves material required and is convenient for adjustment of the pedal 11 back and forth.

Two frames 19 each have an adjusting section 191 on a first end thereof and the adjusting section 191 is inserted into the passage 181. An adjusting screw 183 extends through the inclined restriction hole 182 and contacts against the adjusting section 191. A second end of the each of the frames 19 is connected to the connection portion 15 on the rear board 14 corresponding thereto. In this embodiment, the adjusting screws 183 each have a square head.

It is noted that the rectangular section 181A and the circular section 181B accommodate a section having rectangular cross section and a section having circular cross section of the frame 19.

In this embodiment, the two connection portions 15 each have multiple locking holes 151 and the second end of the frame 19 includes multiple through holes 192 which are located corresponding to the locking holes 151. Screws 193 extend through the through holes 192 and are connected with the locking holes 151 so as to connect the frame 19 to the connection portions 15.

In the first embodiment, when disassembling the frames 19, the adjusting screws 183 are first unscrewed and the adjusting sections 191 of the frames 19 are removed from the passages 181. The adjusting screws 183 do not need to remove from the extension portions 18 to remove the adjusting sections 191 of the frames 19. By this specific arrangement, the users may avoid from lost of small parts when disassembling the pedal assembly. Besides, if the user's foot is too big or small, the adjusting sections 191 of the frames 19 can be adjusted back or forth by loosening the adjusting screws 183 to meet the requirements of the different users.

Figure 4:
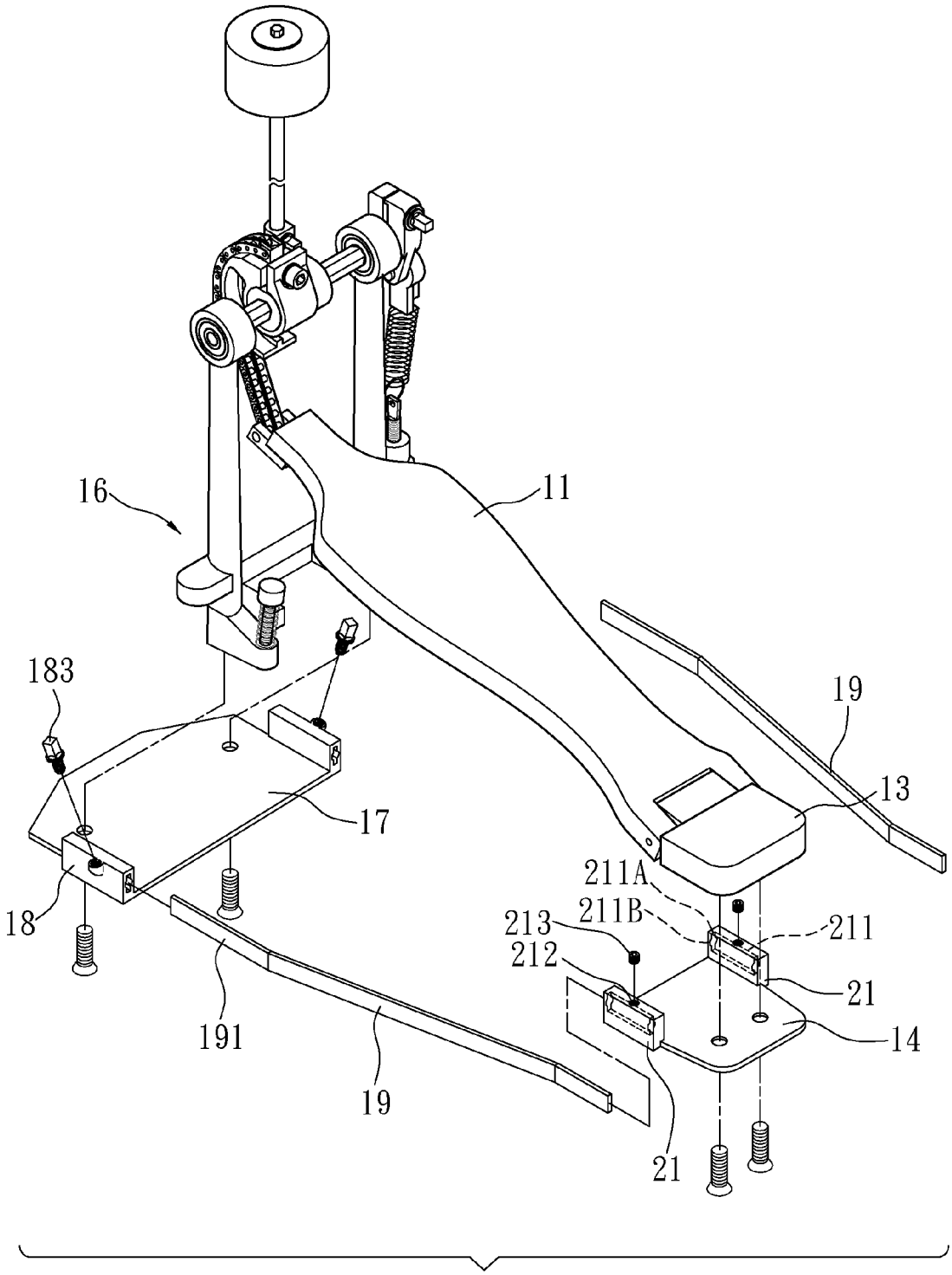
FIG. 4 is an exploded view to show another embodiment of the connection portions of the pedal assembly of the present invention.
Figure 5:
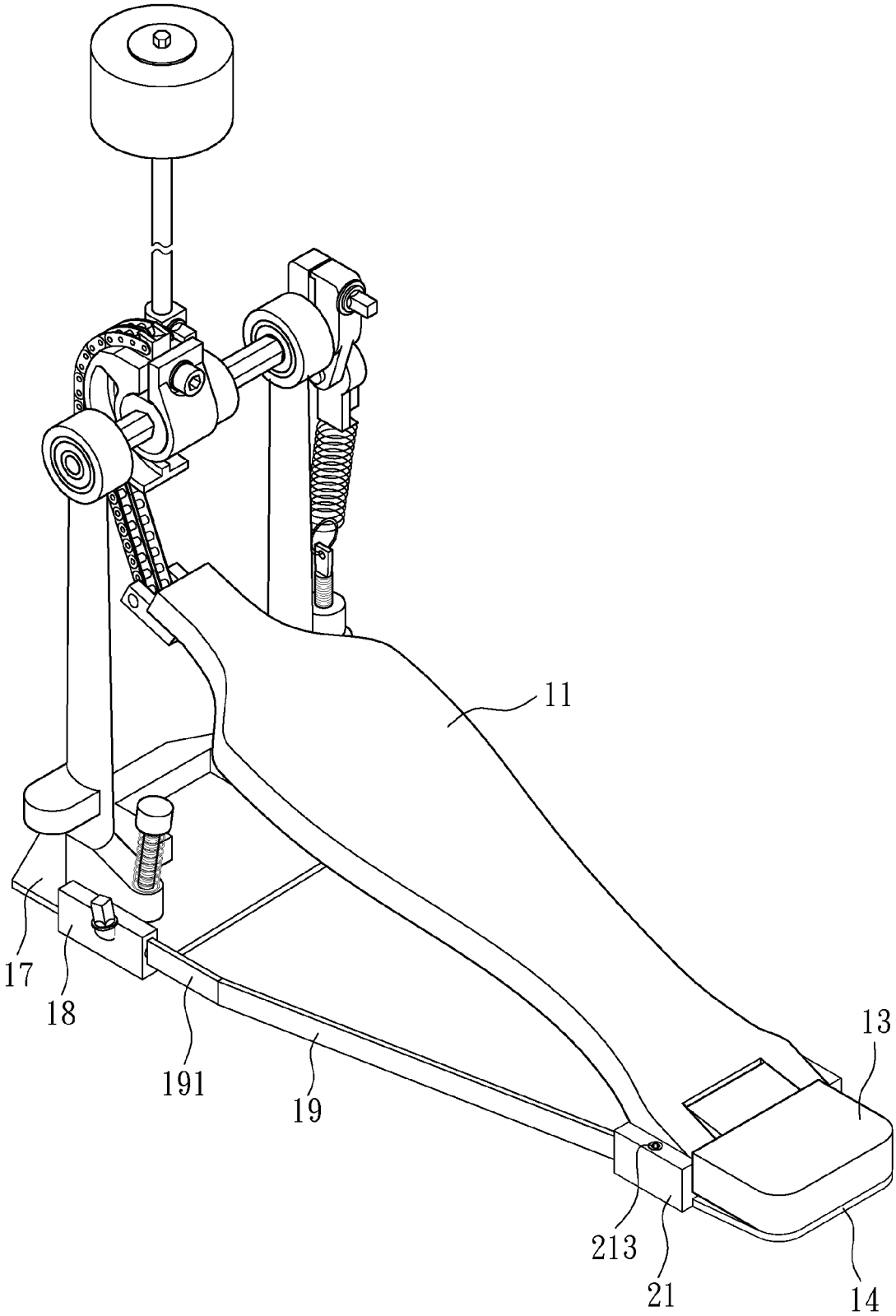
FIG. 5 is a perspective view to show the pedal assembly of the present invention disclosed in FIG. 4.
Figure 6:
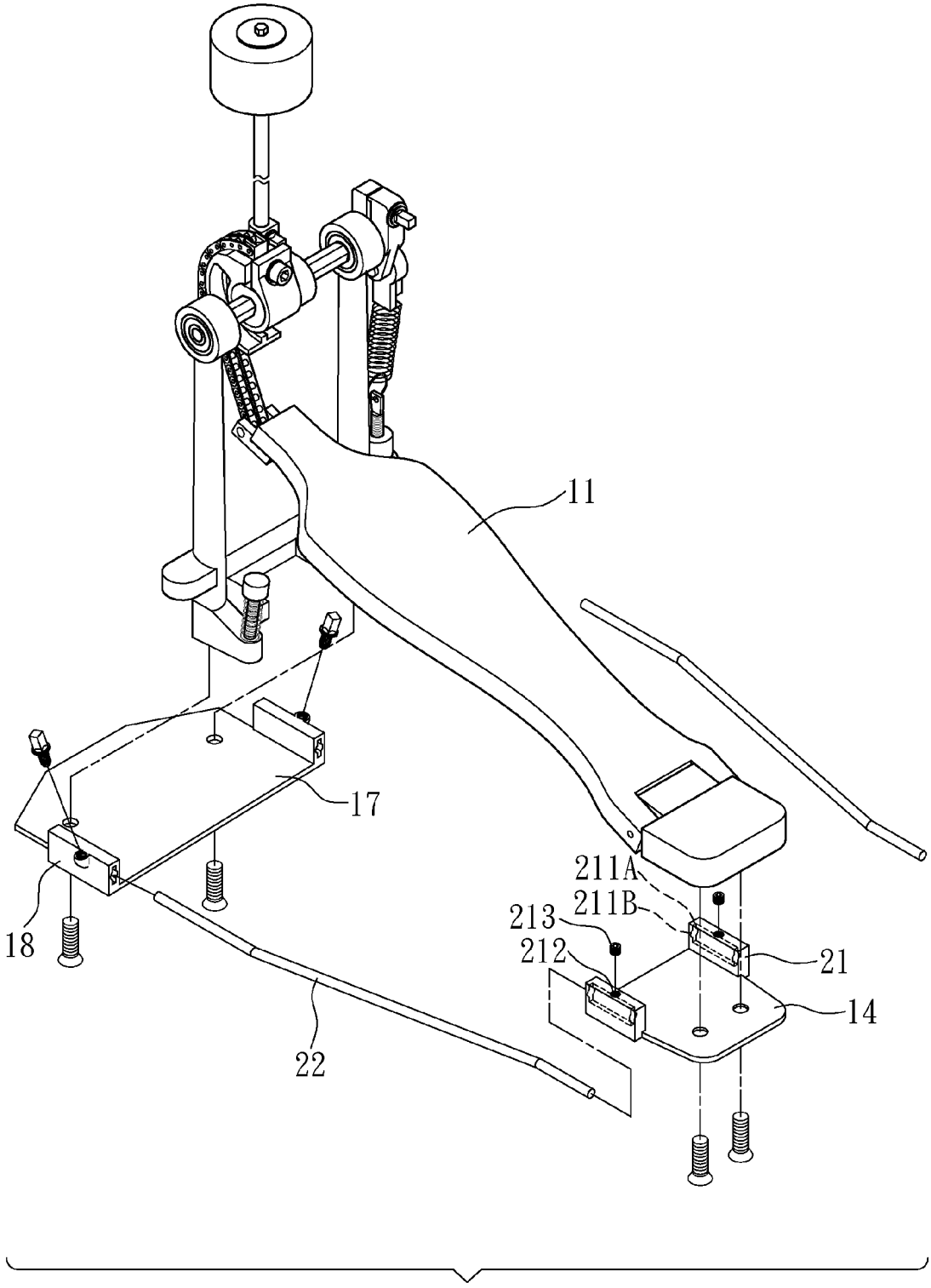
FIG. 6 shows that the frames have circular cross section and the frames are to be inserted into the passages in the passages in the extension portions and the connection portions in FIG. 4.

As shown in FIGS. 4 and 5, each of the connection portions 21 may have a passage 211 defined in a front end thereof which faces the front board 17. The second ends of the frame 19 are inserted into the passages 211. Each of the connection portions 21 includes an insertion hole 212 which includes a bolt 213 received therein so as to contact against the second end of the frame 19. Each passage 211 includes a rectangular section 211A and a circular section 211B which is located at a mediate portion of the rectangular section 211A. The rectangular section 211A and the circular section 211B accommodate a section having rectangular cross section and a section having circular cross section of the frame 19. As shown in FIG. 6, when the frames 19 are cylindrical rods and have circular cross section, the frames 19 are inserted into the passages 211.

Figure 7:
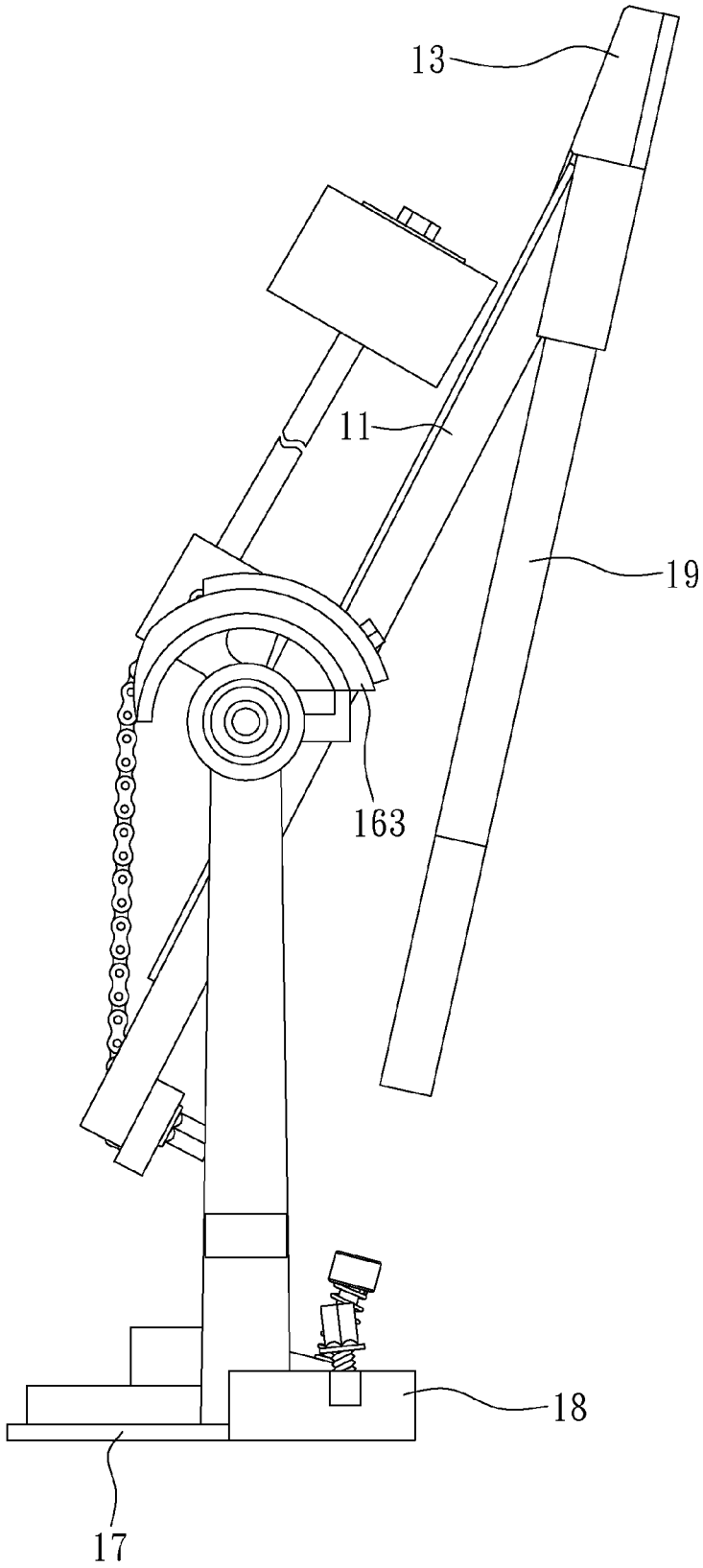
FIG. 7 shows that the frames are removed from the passages and the pedal is folded upward.

As shown in FIG. 7, when the extension portions 18 of the front board 17 and the frames 19 are separated, the heel plate 13 can pivoted toward the locking member 163 to fold the pedal assembly.

Figure 8:
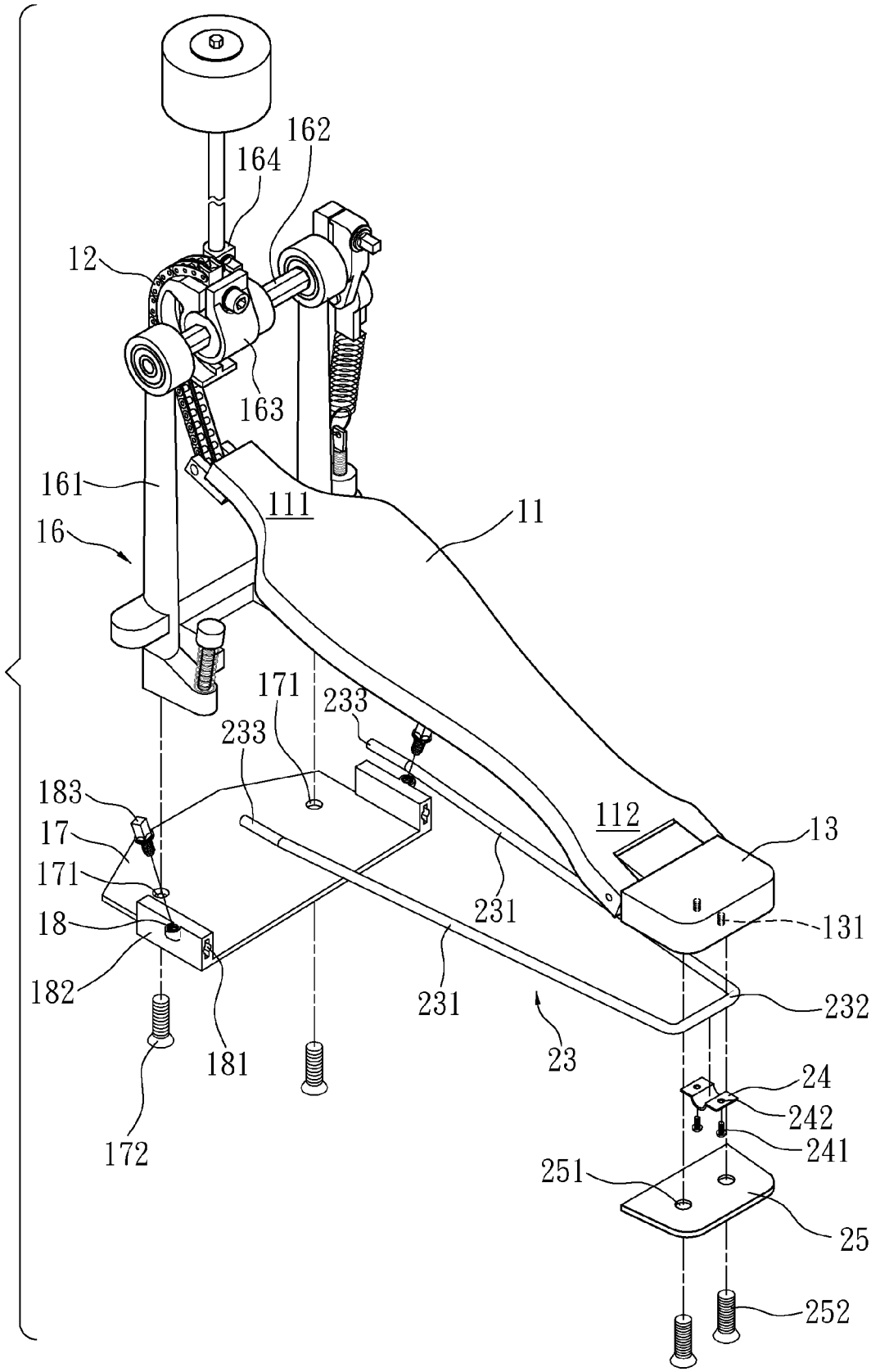
FIG. 8 is an exploded view to show the second embodiment of the pedal assembly of the present invention.
Figure 9:
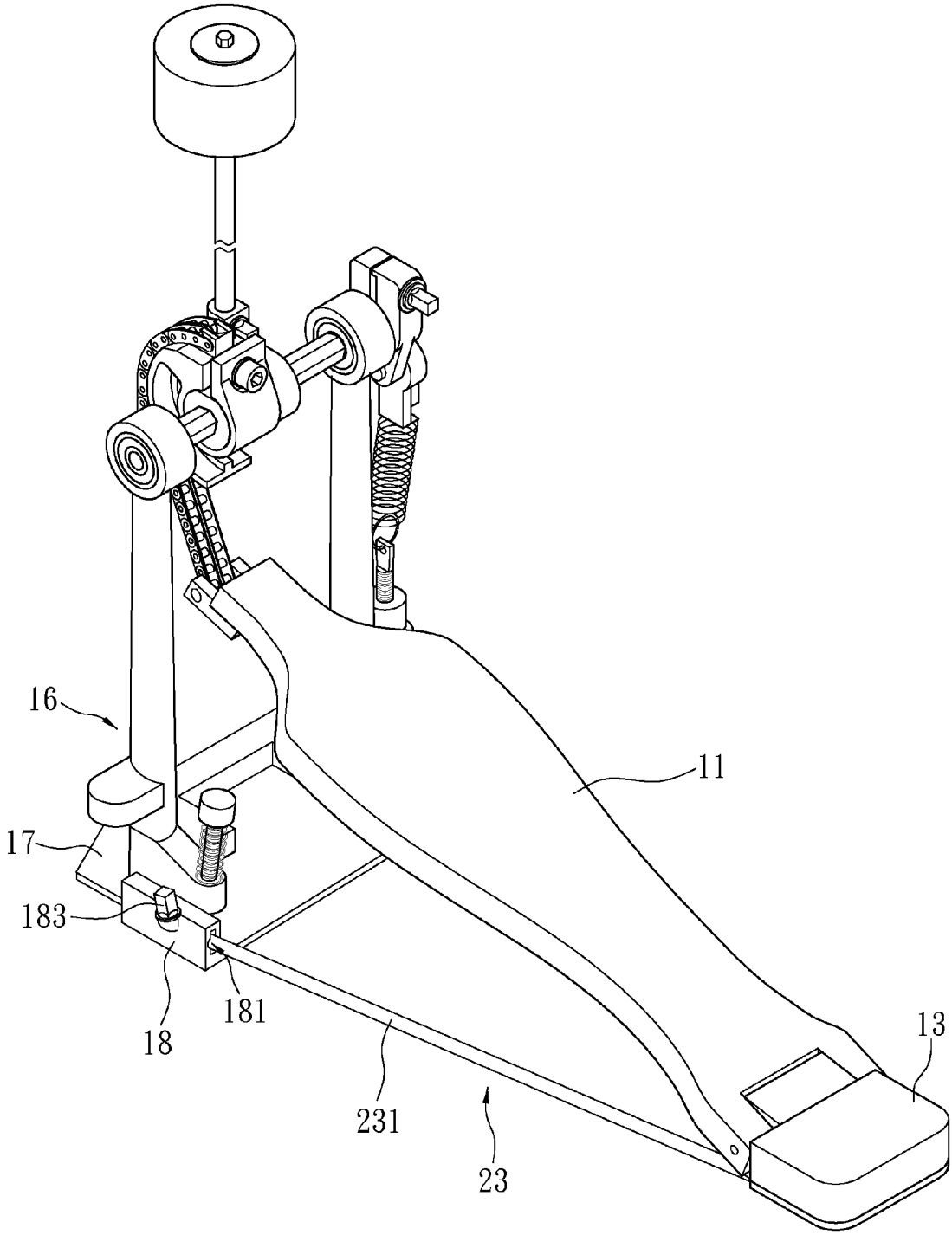
FIG. 9 is a perspective view to show the pedal assembly of the present invention disclosed in FIG. 8.
Figure 10:
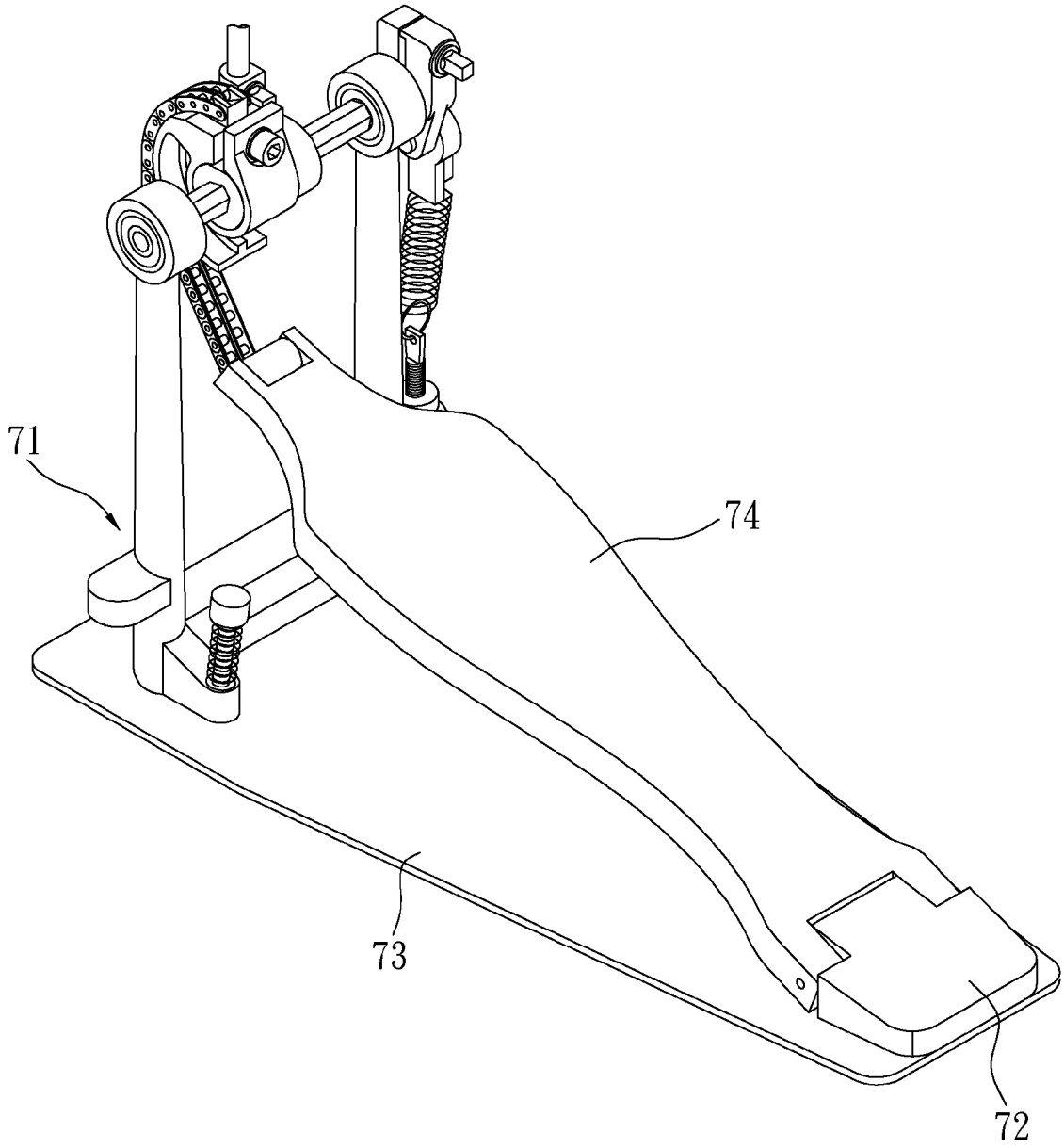
FIG. 10 PRIOR ART
FIG. 10 is a perspective view to show a conventional pedal assembly.
Figure 11:
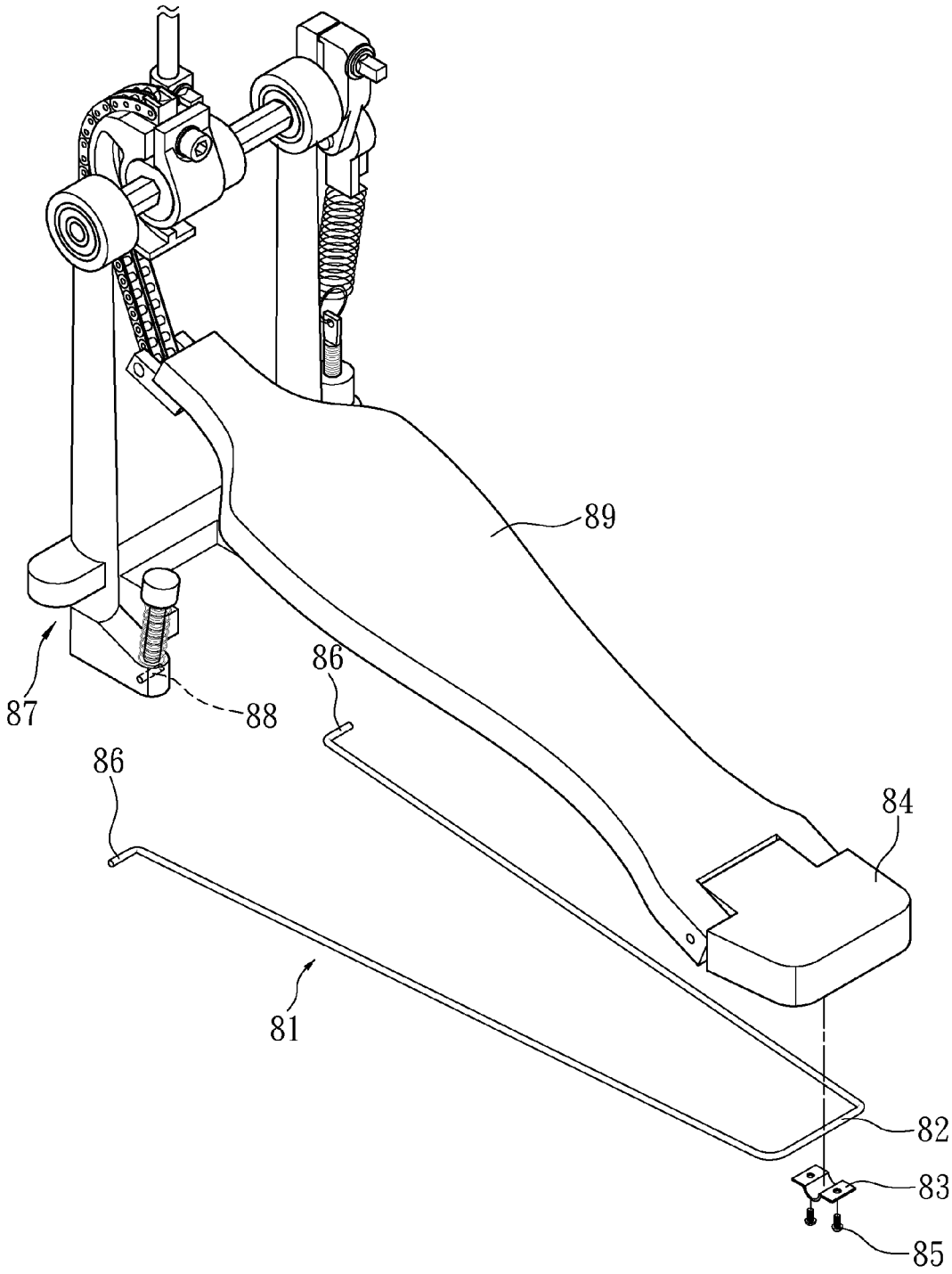
FIG. 11 PRIOR ART
FIG. 11 is an exploded view to show another pedal assembly.

FIGS. 8 and 9 show the second embodiment of the pedal assembly of the present invention which comprises a pedal 11 having a front end 111 thereof connected with a first end of a chain 12 and a rear end 112 of the pedal 11 is connected to a heel plate 13 which includes multiple positioning holes 131. In this embodiment, there are two positioning holes 131. The pedal 11 is pivotable at the rear end 112 thereof.

A base 16 has two posts 161 extending upward from two ends thereof and a shaft 162 is connected between the two posts 161. A locking member 163 is connected to the shaft 162 and a beater connection portion 164 is connected to the locking member 163. A second end of the chain 12 is connected to the locking member 163.

A front board 17 id located beneath the base 16 and the front board 17 includes multiple second holes 171, multiple screws 172 extend through the second holes 171 and are connected to an underside of the base 16. The screws 172 have a flat head. An extension portion 18 extends upward and longitudinally from the two sides of the front board 17. The extension portions 18 each have a passage 181 defined longitudinally through a rear end thereof which faces the heel plate 13. An inclined restriction hole 182 is defined in each of the extension portions 18 and communicates with the passage 181 corresponding thereto. Each of the passages 181 extends through two ends of the extension portion 18 corresponding thereto and includes a rectangular section 181A and a circular section 181B which is located at a mediate portion of the rectangular section 181A.

A U-shaped frame 23 has two legs 231 and a fixing section 232 which is connected between the two legs 231. The U-shaped frame 23 has circular cross section. Each leg 231 includes an adjusting section 233 which is located away from the fixing section 232. The adjusting sections 233 of the two legs 231 are inserted into the passages 181. The circular section 181B accommodates the adjusting section 233 of the frame 23. Each inclined restriction holes 182 including an adjusting screw 183 received therein which contacts against the adjusting section 233. Each adjusting screw 183 has a rectangular head. A positioning member 24 fixes the fixing section 232 to an underside of the heel plate 13. Multiple screws 241 extend through the positioning holes 242 in the positioning members 24 and connect the positioning member 24 to the positioning holes 131. In this embodiment, there are two screws 241 and the screws 251 have a flat head.

In this second embodiment, a rear board 25 is located beneath the positioning member 24 and includes multiple third holes 251. Multiple screws 252 extend through the third holes 251 and are connected to the underside of the heel plate 13. The screws 252 have a flat head.

When disassembling the frames 23, the adjusting screws 183 are first loosened from the front board 17 and the adjusting sections 233 of the frames 23 can be removed from the passages 181 of the extension portions 18. By operating the chain 12, the heel plate 13 can be pivoted toward the locking member 163 to fold the pedal assembly as shown in FIG. 7.

When adjusting the pedal 11 as disclosed in the first embodiment, the adjusting screws 183 are first loosened and the adjusting sections 233 of the frames 23 can be adjusted within the passages 181 of the extension portions 18.

While we have shown and described the embodiment in accordance with the present invention, it should be clear to those skilled in the art that further embodiments may be made without departing from the scope of the present invention.

What is claimed is:

1. A pedal assembly comprising:

a pedal having a front end thereof connected with a first end of a chain and a rear end of the pedal connected to a heel plate, the pedal being pivotable at the rear end thereof;

a rear board connected to an underside of the heel plate and two connection portions located on two sides of the rear board;

a base having two posts extending upward from two ends thereof and a shaft connected between the two posts, a locking member connected to the shaft and a beater connection portion connected to the locking member, a second end of the chain connected to the locking member;

a front board located beneath the base and having an extension portion on each of two sides of the front board, the extension portions each having a passage defined longitudinally therethrough, an inclined restriction hole defined in each of the extension portions and communicating with the passage corresponding thereto, and two frames each having an adjusting section on a first end thereof and the adjusting section inserted into the passage, an adjusting screw extending through the inclined restriction hole and contacting against the adjusting section, a second end of the each of the frames connected to the connection portion on the rear board corresponding thereto.

2. The assembly as claimed in claim 1, wherein the rear board includes multiple first holes and screws extend through the first holes so as to connect the rear board to the heel plate.

3. The assembly as claimed in claim 1, wherein the front board includes multiple second holes and screws extend through the second holes so as to connect the front board to the base.

4. The assembly as claimed in claim 1, wherein each of the passages extends through two ends of the extension portion corresponding thereto and includes a rectangular section and a circular section which is located at a mediate portion of the rectangular section.

5. The assembly as claimed in claim 4, wherein the rectangular section and the circular section accommodate a section having rectangular cross section and a section having circular cross section of the frame.

6. The assembly as claimed in claim 1, wherein the two extension portions extend upward and longitudinally from the two sides of the front board.

7. The assembly as claimed in claim 1, wherein the two connection portions each have multiple locking holes and the second end of the frame includes multiple through holes which are located corresponding to the locking holes, screws extend through the through holes and connected with the locking holes so as to connect the frame to the connection portions.

8. The assembly as claimed in claim 1, wherein each of the connection portions includes a passage defined in a front end thereof which faces the front board, the second ends of the frame are inserted into the passages, each of the connection portions includes an insertion hole which includes a bolt received therein so as to contact against the second end of the frame.

9. The assembly as claimed in claim 8, wherein each passage includes a rectangular section and a circular section which is located at a mediate portion of the rectangular section.

10. The assembly as claimed in claim 9, wherein the rectangular section and the circular section of each passage accommodate a section having rectangular cross section and a section having circular cross section of the frame.

11. A pedal assembly comprising:

a pedal having a front end thereof connected with a first end of a chain and a rear end of the pedal connected to a heel plate which includes multiple positioning holes, the pedal being pivotable at the rear end thereof;

a base having two posts extending upward from two ends thereof and a shaft connected between the two posts, a locking member connected to the shaft and a beater connection portion connected to the locking member, a second end of the chain connected to the locking member;

a front board located beneath the base and having an extension portion on each of two sides of the front board, the extension portions each having a passage defined longitudinally through a rear end thereof which facing the heel plate, an inclined restriction hole defined in each of the extension portions and communicating with the passage corresponding thereto, and a U-shaped frame having two legs and a fixing section which is connected between the two legs, each leg including an adjusting section which is located away from the fixing section, the adjusting sections of the two legs inserted into the passages, each inclined restriction holes including an adjusting screw received therein which contacts against the adjusting section, a positioning member fixing the fixing section to an underside of the heel plate, multiple screws connecting the positioning member to the positioning holes.

12. The assembly as claimed in claim 11, wherein the front board includes multiple second holes and multiple screws extend through the second holes and are connected to an underside of the base.

13. The assembly as claimed in claim 11, wherein a rear board is located beneath the positioning member and includes multiple third holes, multiple screws extend through the third holes and are connected to the underside of the heel plate.

14. The assembly as claimed in claim 11, wherein each of the passages extends through two ends of the extension portion corresponding thereto and includes a rectangular section and a circular section which is located at a mediate portion of the rectangular section.

15. The assembly as claimed in claim 14, wherein the circular section accommodates the adjusting section of the frame.

16. The assembly as claimed in claim 11, wherein the two extension portions extend upward and longitudinally from the two sides of the front board.

* * * * *